US007431642B2

(12) United States Patent
Herbst

(10) Patent No.: US 7,431,642 B2
(45) Date of Patent: Oct. 7, 2008

(54) EXHAUST FAN HAVING A UNITARY MOLDED HOUSING

(75) Inventor: Walter Herbst, Lake Forest, IL (US)

(73) Assignee: J. F. Meskill Enterprises, LLC, Cleveland, OH (US)

( * ) Notice: Subject to any disclaimer, the term of this patent is extended or adjusted under 35 U.S.C. 154(b) by 152 days.

(21) Appl. No.: 11/278,488

(22) Filed: Apr. 3, 2006

(65) Prior Publication Data

US 2006/0223435 A1 Oct. 5, 2006

Related U.S. Application Data

(60) Provisional application No. 60/668,151, filed on Apr. 4, 2005.

(51) Int. Cl.
*F24F 7/06* (2006.01)
*F24F 13/078* (2006.01)
*F04D 29/42* (2006.01)

(52) U.S. Cl. ..... 454/341; 454/354; 415/204

(58) Field of Classification Search ..... 454/260, 454/290, 292, 293, 294, 295, 354, 341; 362/480, 362/547, 576; 415/204
See application file for complete search history.

(56) References Cited

U.S. PATENT DOCUMENTS 3,950,638 A * 4/1976 Kent et al. ..... 362/297
4,527,960 A 7/1985 DeSisto
5,426,900 A 6/1995 Springer
5,718,120 A * 2/1998 Sakurai ..... 62/126
5,879,232 A * 3/1999 Luter et al. ..... 454/349
5,934,783 A * 8/1999 Yoshikawa ..... 362/96
6,017,375 A * 1/2000 Duell et al. ..... 55/356
6,439,839 B1 * 8/2002 Song et al. ..... 415/119
6,585,486 B2 * 7/2003 Birdsell et al. ..... 415/213.1
6,990,824 B1 1/2006 Jaffer et al.
2005/0218157 A1 10/2005 McMahon et al.
2005/0230416 A1 10/2005 McMahon et al.
2006/0021368 A1 2/2006 Jaffer et al.
2006/0090491 A1 5/2006 Jaffer et al.
2006/0196002 A1 9/2006 Schlapkohl
2006/0217697 A1 9/2006 Lau et al.
2006/0217706 A1 9/2006 Lau et al.

FOREIGN PATENT DOCUMENTS

JP 2003242808 A * 8/2003

* cited by examiner

*Primary Examiner*—Steven B. McAllister
*Assistant Examiner*—Patrick F. O'Reilly, III
(74) *Attorney, Agent, or Firm*—Fay Sharpe LLP

(57) ABSTRACT

The subject invention relates to ventilation systems that include a unitary molded housing that defines a flow path and one or more mounting structures, wherein the flow path and the mounting structures are integrated into the unitary molded housing. An exterior structure is coupled to the unitary molded housing, the exterior structure includes at least one inlet port, the at least one inlet port being concealed from view. At least one recess is coupled to the exterior structure that accommodates at least one illumination element.

18 Claims, 4 Drawing Sheets

EXHAUST FAN HAVING A UNITARY MOLDED HOUSING

CROSS REFERENCE TO RELATED PATENTS AND APPLICATIONS

This application claims priority from U.S. Provisional Patent Application Ser. No. 60/668,151 filed Apr. 4, 2005 and is incorporated herein by reference.

BACKGROUND OF THE INVENTION

Various systems and methods are conventionally employed to illuminate spaces located in a building. Lighting can be provided directly, indirectly or diffusely depending on the space, purpose of illumination and user preference. In a standard configuration, an illumination device includes a housing a mounting bracket and a light element receptacle. The housing can be fabricated utilizing any number of materials such as brass, aluminum, stainless steel, or any number of plastics. The light element receptacle can accept specific elements manufactured for such a purpose. Such element types include incandescent, halogen, compact fluorescent, fluorescent, high intensity discharge (HID) and the like.

For some applications, a multi-function device may be desired to provide one or more disparate features. For example, additional features such as air purification, smoke detection or ventilation may be desired. Conventionally, such multi-function devices employ non-functional designs that are well known in the art. A cosmetic housing or other ornamental feature may be employed to provide continuity with a particular design scheme.

Ventilation devices have been available for many years. Many of these products are recessed in a ceiling and connected to a duct leading to the exterior of a home or other structure. A basic ventilation device includes an electrical enclosure and a fan driven by an electric motor. Typically, the device is switched so that a user may energize the motor causing the fan to draw air through a grill and exhaust it through the duct to the outside atmosphere. Over the years, additional features have been added to ventilation devices. For example, some ventilation devices now include a ceiling light. The ceiling light is typically a conventional light bulb in the enclosure with a translucent diffuser or lens below it. In many products, the exhaust fan is separately switched from the light.

Conventional and/or multi-function devices suffer from several drawbacks such as excessive noise; inefficient design, awkward installation, incompatibility with electrical interfaces, difficult maintenance and the like. Such difficulties can be caused by inadequate or poor design and/or incorrect implementation of the lighting device. What are needed are systems and methods that address shortcomings associated with conventional lighting and multifunction devices.

BRIEF SUMMARY OF THE INVENTION

According to one aspect of the subject invention, ventilation systems include a unitary molded housing that defines a flow path and one or more mounting structures, wherein the flow path and the mounting structures are integrated into the unitary molded housing An exterior structure is coupled to the unitary molded housing, the exterior structure includes at least one inlet port, the at least one inlet port being concealed from view. At least one recess is coupled to the exterior structure that accommodates at least one illumination element.

According to another aspect of the subject invention, a ventilation component includes a unitary molded housing that defines a flow path and one or more mounting structures. A ventilator structure is coupled to the unitary molded housing, the ventilator structure includes a curved and/or segmented downwardlingly facing face plate which includes one or more steps configured such that one or more pairs of steps have similar offset distances relative to the ventilator structure. At least one inlet port allows air to be drawn into the flow path from a first space and at least one exhaust port allows air to be expelled from the flow path into a second space. An impeller draws air into the at least one inlet port from the first space to the flow path and expels air from the flow path into the second space via the at least one exhaust port. One or more exhaust fan intake slots are disposed at either end panel of the ventilator structure.

According to yet another aspect of the subject invention, a ventilation component comprises a unitary molded housing that defines a flow path and one or more mounting structures. An exterior ventilator structure is coupled to the unitary molded housing that includes a rectangular base that supports an oversized rectangular face plate with rounded corners and a curvature of a downwardly convex shape. The exterior ventilation structure includes one or more illumination elements. At least one inlet port in the exterior ventilator allows air to be drawn into the flow path from a first space, wherein each inlet port is a slot located in the outer portion of the face plate which is generally parallel to the outer edge of the face plate. At least one exhaust port is integrated into the unitary molded housing wherein air is expelled from the flow path into a second space. An impeller is coupled to the unitary molded housing that draws air into the at least one inlet port from a first space to the flow path and expels air from the flow path into a second space via the at least one exhaust port. A switch employs a momentary action that is coupled to the ventilation component to provide power to at least one of the one or more illumination elements and the impeller.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
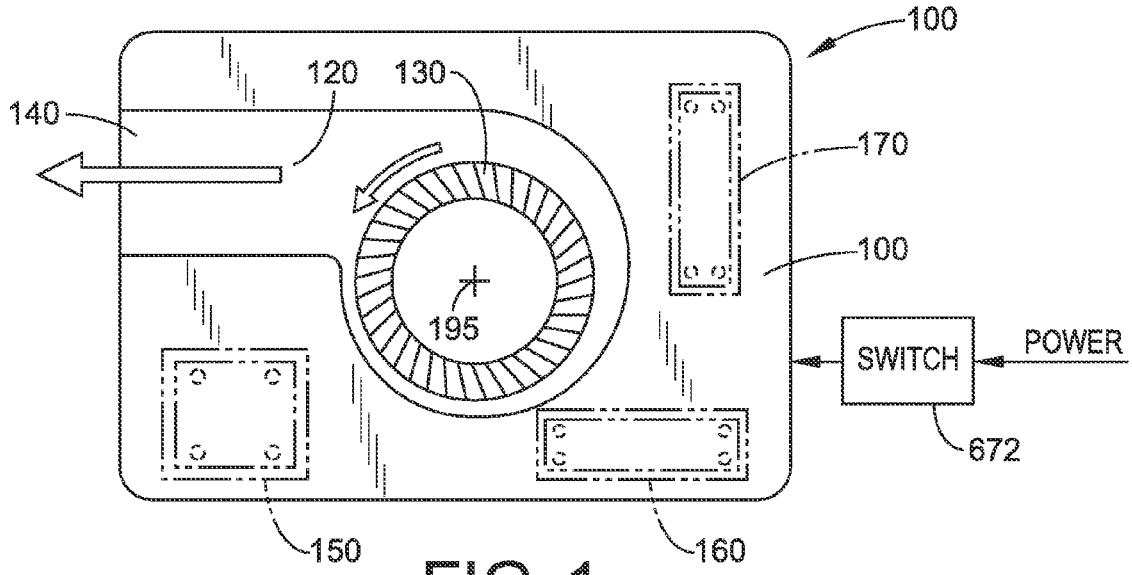
FIG. 1 is an illustration of a ventilation component in accordance with an exemplary embodiment.

FIG. 1 illustrates a top view of a ventilation component 100 which can be mounted to a flat surface such as a wall or ceiling, for example. The ventilation component 100 can be employed to draw air from a particular space and to expel such air into another space (e.g., atmosphere, etc.) The ventilation component 100 can be employed in a residential and/or commercial environment wherein ventilation of a space is desired.

In one embodiment, the ventilation component 100 includes a unitary molded housing 110, a flow path 120, an impeller 130, and an exhaust port 140. The impeller 130 is employed to draw air from a space into the flow path 120 and expel this air through the flow path 120 via the exhaust port 140. As shown, the flow path 120 is scroll shaped wherein the impeller 130 is generally located at a center point relative to the scroll. The shape of the flow path 120 can provide numerous advantages over conventional ventilation components For example, the shape of the flow path 120 can increase efficiency of exhausting air from a space. In one aspect the throughput (e.g., cubic feet per minute) of air flow through the ventilation component 100 can be increased. Also, the design of the flow path 120 can lessen noise as air can be directed to minimize standing waves found in conventional designs.

Low noise output can also be realized utilizing the unitary molded housing 110. The unitary molded housing 110 defines one or more structures to define walls for the flow path 120, an electrical enclosure 150 and mounting points for a blower motor 160, a light support beater 170, and the like. All of these structures can be integrated into a molded housing with materials and electrical design that can allow for a UL or other safety agency approval. It is to be appreciated that the unitary molded housing 110 can include substantially any number of structures to accommodate substantially any number of components, mounting surfaces, etc. included a particular unitary molded housing 110 design.

The unitary molded housing is not constructed from metal sheet material. Metal sheets are prone to vibration. A metal sheet will often create noise when an electric motor attached to the sheet is running. A metal sheet will often create noise when air is rapidly blown along its length. The unitary molded housing of the present invention is less prone to vibration and therefore creates less noise when supporting an electric motor or confining a flow of air.

Not only do metal sheets create noise on their own, when joined into an assembly, metal sheets often create noise at their joining points. Thus) when one metal sheet is held against a second metal sheet in a fan housing, the one sheet may vibrate at its end creating a very rapid series of impacts against the second metal sheet resulting in a buzz. In such cases, vibration dampening filler or other material may be required to mitigate noise and/or material wear resulting therefrom.

In contrast, a unitary molded housing can reduce noise levels, maintain adequate air capacity and improve electrical efficiency. Reduced noise can be achieved since the number of unsecured components is minimized. In this manner, less parts can vibrate when the ventilation component 100 is in operation. Further, use of polymer materials (e.g., in place of metal) for various components can help reduce noise levels since they can create low noise output when under vibration.

Improved efficiency can be aided by the design of the flow path 120 by allowing use of a less powerful motor to achieve a desired air flow capacity. For example, air flow paths can be smoother and more efficient (e.g., direct) based on the design of the walls and other structures that define air flow through the ventilation component 100. In this manner, the unitary molded housing 110 can define the flow path 120 and exterior structure of the ventilation component 100 to provide lower noise and improved efficiency over conventional ventilation devices.

The impeller 130 can be a motor coupled to a structure that has one or more vanes that cause a flow of air when the structure is rotated. In one aspect, the structure is a "squirrel cage" wherein the structure has a cylindrical shape. The walls of the "squirrel cage" can include a plurality of vanes which extend from the top to the bottom of the structure. The vanes are angled to direct air in a particular direction when the structure is rotated. When the impeller 130 is rotated, the vanes are angled to draw air into the unitary molded housing 110 Via the one or more inlet ports (not shown). Air flow is directed into the center of the "squirrel cage". Such air is pushed out of the "squirrel cage" and expelled from the center of the "squirrel cage" into the flow path 120. Once in the flow path 120, air is forced out of the unitary molded housing 110 via the exhaust port 140.

In one aspect, the flow path 120 can have a cross-sectional shape that is circular, square, rectangular, elliptical, etc. Such cross-sectional design can be defined to accommodate one or more predefined parameters. For example, a throughput requirement might dictate the use of a particular air flow path that correlates to a particular impeller type. The exhaust port 140 can be coupled to the flow path 120 to direct the flow of air out of the ventilation component 100. The exhaust port 140 can be shaped to accommodate the cross sectional shape of the flow path 120 to which it is coupled The exhaust port 140 can be coupled to the flow path 120 via one or more means such as screws, rivets, pins, etc. In one embodiment, the exhaust port 140 has a larger radius than the flow path 120 such that the exhaust port.140 is placed around the perimeter of the flow path 120 utilizing an interference fit. In another embodiment, the exhaust port 140 is part of the unitary molded housing 110. In this example, the shape of the exhaust port 140 can be molded to direct flow in a desired manner.

The exhaust port 140 can be coupled to an exit path (not shown) such as a duct, an air passage, a vent and the like. The exit path can allow air exhausted from the ventilation component 100 to be expelled to one or more desired locations typically outside the structure. The exhaust port 140 can be designed to accommodate the size and shape of the exit path such to provide efficient air flow and/or reduce noise. In one example, the shape of the exhaust port 140 can be flared or convergent to accommodate the larger or smaller size of a particular exit path. For instance, the flow path 120 can have a circular cross-section with a diameter of three inches and the exit path can be a circular duct with a diameter of five inches. In this example, the exhaust port 140 can have a flared shape wit a diameter of three inches on a first side and a diameter of five inches on a second side. In this manner, the air can be exhausted from the ventilation component 100 to a disparate space via the exit path.

Figure 2:
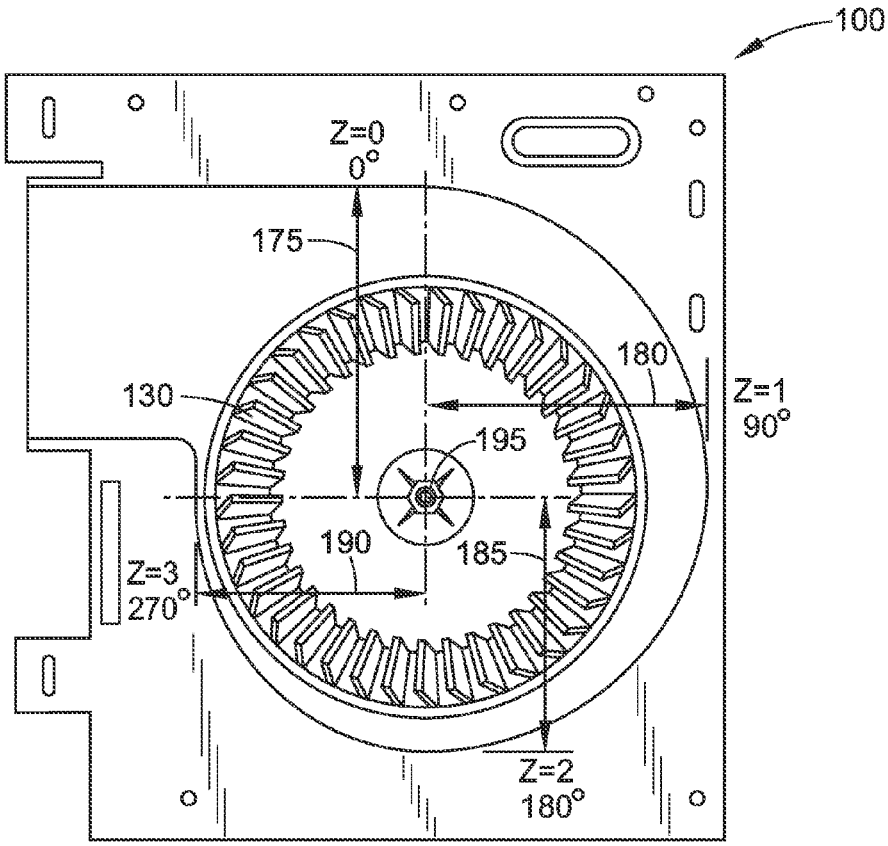
FIG. 2 is an illustration of a particular air flow path utilized in a ventilation component in accordance with an exemplary embodiment.

FIG. 2 shows a particular flow path 120 design that can minimize noise and/or be matched to one or more impeller designs to optimize efficiency of air expelled from the ventilation component 100. For example, a particular impeller design can draw in air at a certain rate and in one or more particular directions. In one aspect, air drawn in at a particular rate can be correlated to a specific flow path 120 shape to allow maximum efficiency and throughput.

In one embodiment, the shape of the flow path 120 surrounds the impeller in an ascending spiral. An ascending spiral can generally have a shape wherein the distance (radius) from a center point increases as a radian value, degree value, etc. varies. An ascending spiral is described with reference to minimum radius as a starting point such that the value increases from that point.

For simplicity, this curve can also be described as a descending spiral wherein the starting point is the maximum radius from the center point. In this description, the distance decreases as the radian value, degree value, etc. decreases. In one approach, an entire circular path (e.g., three hundred and sixty degrees, 2π, etc.) can be described with a value Z, wherein Z varies by one for every ninety degree segment variance. Thus, a first point conventionally labeled zero degrees can instead have a Z value of 0. This zero point can be the maximum radius from the center point. From this point, the Z value corresponding to ninety degrees, one hundred and eighty degrees, and two hundred and seventy degrees are 1, 2 and 3 respectively.

The radii relative to the Z value of 0, 1, 2, and 3 can be defined by a radius A 175, a radius B 180, a radius C 185, and a radius D 190 respectively. The radii extend from a common center point 195 (e.g., the center of the impeller 130). In one embodiment, the radii can be expressed as an equation;

$$XY^Z = \text{radius} \quad (1)$$

wherein X is the radius A, Y is a constant, and Z is a real number from zero to three, wherein zero corresponds to the first radius and three corresponds to the third radius. This function describes a surface of decreasing radius with increasing angle. As described above, Z is a number corresponding to the angle of a line from the center of the impeller 130 to the outer wall of the flow path 120. "Radius" is the distance from the center point 195 to the outer surface of the flow path 120.

In one example, X is equal to 4, Y is equal to 0.9, and Z is a real number with a value of zero, one, and two. Here, the radius A expressed when Z=0 is orthogonal to the radius B expressed when Z=1, which is orthogonal to the radius C express when Z=2. In one approach, the radii are all located on the same plane. Utilizing these values in Equation 1, the first radius has a value of 3.25 inches, the second radius has a value of 3.63 inches and the third radius has a value of 4 inches. The radius changes smoothly and continuously in value between the quarter circle points described. As expressed by Equation 1, the first radius is about eighty percent of the distance of the third radius and the second radius is about ninety percent of the distance of the third radius. It is to be appreciated that the values of X, Y, and Z can vary to express one or more disparate flow path curves.

FIGS. 3-7 illustrate exterior structures of the ventilation component 100 that provide functional advantages over conventional structures. In one example, the exterior structures can provide light and/or ventilation to a space as desired. Light can be provided via one or more high power and/or low power illumination elements. High power illumination elements can include halogen lamps, high intensity discharge lamps, incandescent lamps, and/or fluorescent lamps. Low power illumination elements can include one or more LEDs and/or an electroluminescent panel.

Figure 3A:
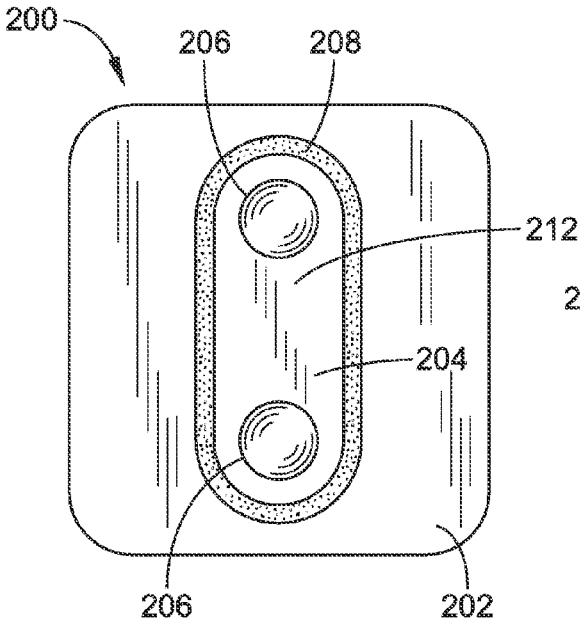
FIGS. 3*a* and 3*b* are an illustration of an exterior ventilation structure is accordance with an exemplary embodiment.
Figure 3B:
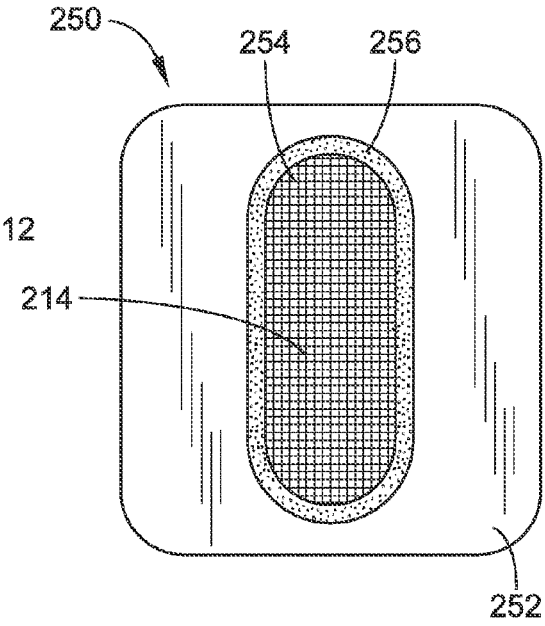

FIGS. 3*a* and 3*b* illustrate two rectangular exterior ventilator structures 200 and 250. The ventilator structures 200 and 250 each include a downwardly facing face plate 212, 214 with a gentle radius of curvature in one axis only. This face plate sits below a rectangular base 202, 252. At least two of the walls of the base have open slots 208, 256 resembling a louver surface providing the intakes for the blower. The sides of the base are recessed with respect to the edges of the face plate 212, 214. In this manner, the inlet slots are shielded from view. In this manner, the unit maintains a clean appearance regardless of dirt accumulation around the intake ports of the ventilation component 100.

In addition, each exterior structure 200, 250 has a race track shaped central portion 204, 254. With regard to exterior structure 200 and 250, the long sides of the race track portion 204, 254 are parallel to the long sides of the face plate 212, 214. With particular reference to exterior structure 250, the "infield" of the race track 254 is a lens behind which resides an illumination element such as an incandescent or fluorescent bulb and/or one or more electroluminescent illumination devices. Alternatively, exterior structure 200 shows the infield of the race track 204 is primarily an opaque panel with two circular apertures 206 wherein one embodiment accommodates halogen or other high intensity lamps, for example. Halogen lamps can provide intense, efficient lighting in small packaging and are therefore an advantage in a small bathroom appliance.

The race track portion 204, 254 is a curved portion of the face plate 212, 214 joining the face plate 212, 214 at its outer periphery and curving upwardly to an edge slightly behind the panel forming the infield portion of the race track 254. In this manner, the race track portion 204, 254 can provide an additional concealed air flow path. This can be used as an additional exhaust intake or can be used as the output flow path for a heater feature (not shown) in the ventilation component 100. Again, the slot is concealed by a horizontal member below the air flow path and therefore will appear clean.

Figure 4:
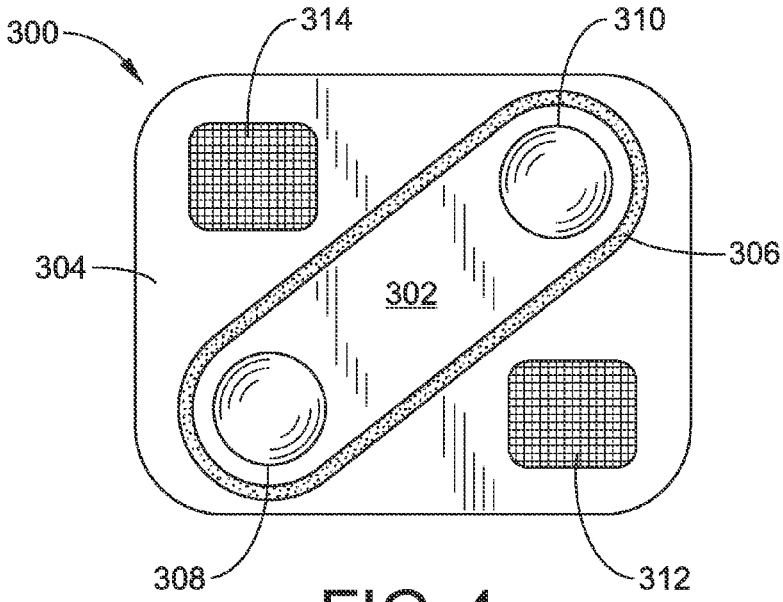
FIG. 4 is an illustration of an exterior ventilation structure is accordance with an exemplary embodiment.

FIG. 4 illustrates an exterior ventilator structure 300 which can provide light and/or ventilation to a particular space. The ventilator structure 300 can include the ventilation component 100 as described above wherein air is drawn into and expelled from the ventilator structure 300 into one or more disparate locations. In this embodiment, a race track component 302 is oriented in a diagonal corner-to-corner orientation relative to a housing 304. An open slot 306 surrounds the race track component 302 to provide air inlet means for the ventilator structure 300. The actual inlet means to the ventilation component 100 is hidden from view and thus can conceal accumulated dirt, dust, etc. from view.

Two high power illumination elements 308, 310. (e.g., halogen lamps) are disposed at two ends of the race track component 302. Two low power illumination elements 312, 314 can be provided in two corners not occupied by the race track component 302 and can be employed to provide supplemental low temperature lighting. The low power illumination elements 312, 314 can be sized and/or configured as desired to accommodate a particular illumination, color, power requirement, etc.

In one approach, the low power illumination elements 312, 314 can be utilized as a night light and can be separately switched as desired. Alternatively, the low power illumination elements 312, 314 can be switched with the main lighting of the high power illumination elements 308, 310. In yet another alternative, power can be provided to the ventilator structure 300 to drive the high power illumination elements 308, 310, the low power illumination elements 312, 314, and the ventilation component 100 independently or together as desired. In one aspect, the low power illumination elements 312, 314 can be electroluminescent panels and/or LEDs.

Figure 5A:
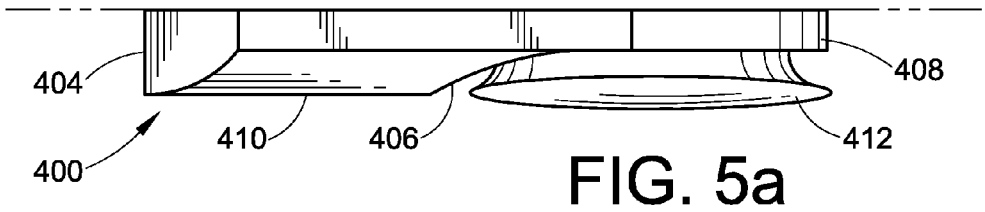
FIGS. 5*a* and 5h are an illustration of an exterior ventilation structure is accordance with an exemplary embodiment.
Figure 5B:
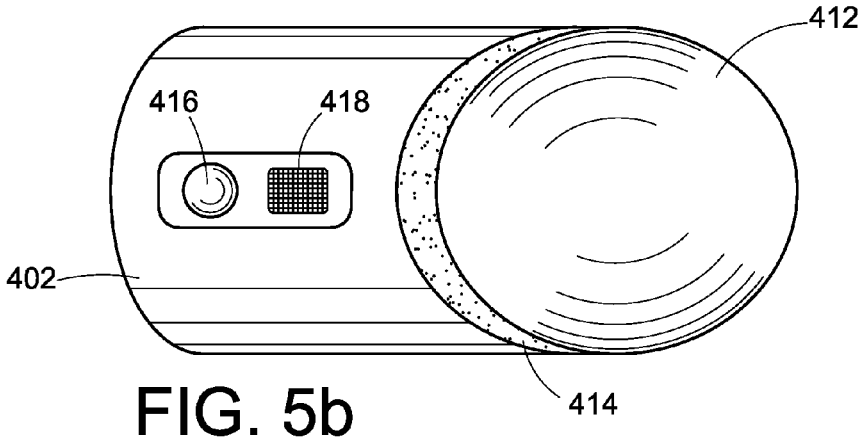

FIGS. 5*a* and 5*b* illustrate a side and a top view of an external ventilator structure 400 which can include the ventilation component 100, as described above. As described in detail below, the ventilator structure 400 can provide light and/or ventilation to a particular space. The ventilator structure 400 includes a base 402 having two parallel vertical side walls, a rear vertical wall 404 having a curve of uniform radius of curvature bulging rearwardly at its center, and a front wall 406 of complex shape.

The front wall 406 has a short vertical planar segment adjacent each side wall and a central segment 408 of uniform curvature forming a semicircular segment. A first face plate 410 connects the bottom edges of the two side walls and the rear wall. The first face plate 410 has a gentle curvature and is convex when viewed from below. The forward edge of the first face plate 410 surface is concave. A mushroom shaped component 412 sits within the apparent cavity created by the concave forward edge of the first face plate 410. The mushroom shaped object 412 has a domed downwardly facing surface forming a second face plate. A curving recessed base wall extends upwardly from the dome surface of the mushroom shaped component 412. This structure is half contained within the concave edge of the first face plate 410 and the central segment 408.

The first face plate 410 includes an upwardly sloping segment 414 directly adjacent the semicircular forward edge and providing a surface extending under the dome of the second face plate. This conceals an air intake area completely surrounding the dome. Thus, the inlet ports are completely concealed and, should they become soiled, the external ventilator structure 400 maintains a clean appearance.

The external ventilator structure 400 can have various embodiments consistent with the above description. For example, according to one approach, the dome of the mushroom shaped component 412 can be completely opaque. In another approach, the dome can be a translucent lens providing the cavity for one or more illumination elements. In yet another approach, a first recess 416 can be employed to accommodate a halogen bulb and a second recess 418 can accommodate an electroluminescent panel centered in the base 402. Also, the external ventilator structure can include a circular lens at the center of the dome providing a primary light in addition to the halogen light and electroluminescent panel.

Figure 6A:
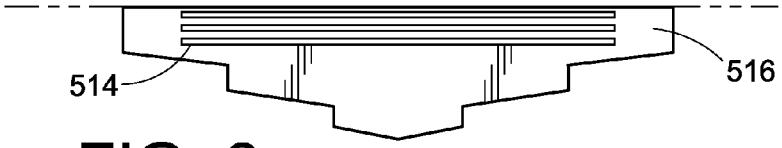
FIGS. 6*a* and 6*b* are an illustration of an exterior ventilation structure is accordance with an exemplary embodiment.
Figure 6B:
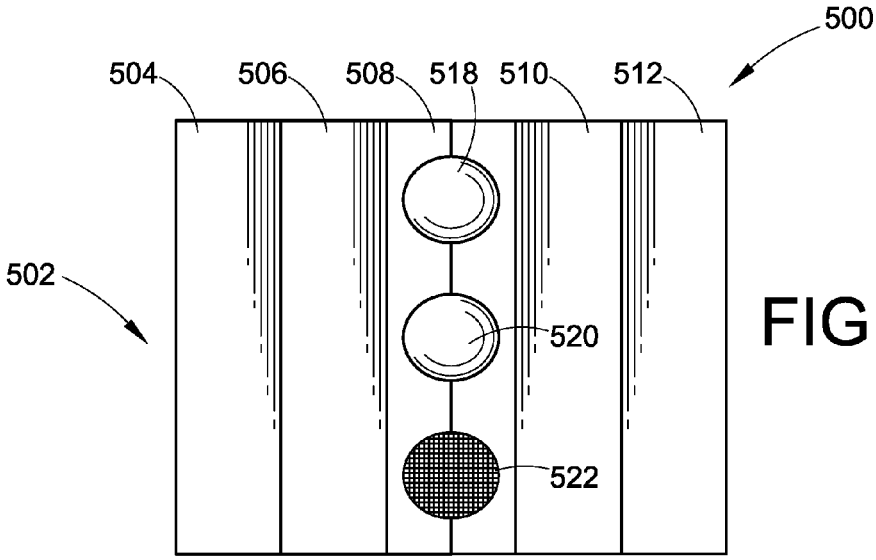

FIGS. 6*a* and 6*b* illustrate a side and a top view of an exterior ventilator structure 500 that can provide light and/or ventilation to a space. The ventilator structure 500 includes a gently curved and segmented downwardlingly facing face plate 502. The face plate 502 can include a plurality of steps 504, 506, 508, 510, and 512. The steps can be configured such that pairs of steps have similar offset distances which are relative to the ventilator structure 500. In one embodiment, steps 504 and 512; and 506 and 510 have similar offsets, wherein steps 506 and 510 have a larger offset than 504 and 512. Further, step 508 can have an offset which is larger than 506 and 510. In one embodiment, the steps 504-512 can have a brushed stainless surface. However, it is to be appreciated that the face plate 502 can be substantially any material and/or surface desired.

Exhaust fan intake slots 514 are disposed at either end panel 516 of the exterior ventilator structure 500. In one approach, step 508 of the face plate is opaque. In another approach step 508 is a lens providing an illumination source such as a lamp, bulb, electroluminescent panel and the like. In yet another approach, three small circular light receptacle 518, 520, and 522 are provided. In one embodiment, light receptacles 518 and 520 can accommodate halogen lamps whereas the light receptacle 522 can support an electroluminescent surface. It is to be appreciated that the light receptacles can accommodate substantially any combination of illumination sources.

Figure 7A:
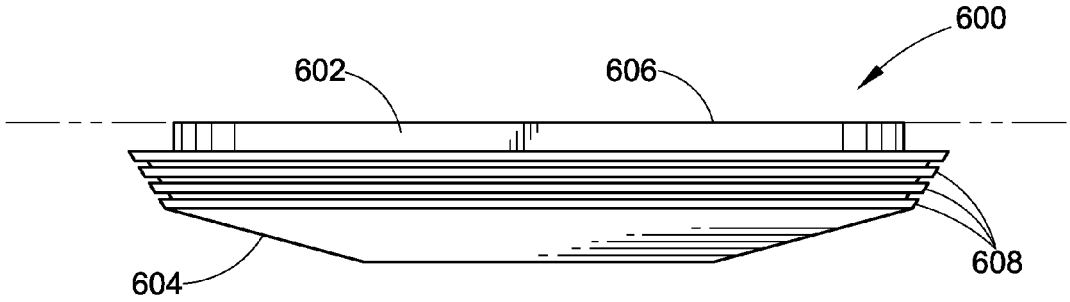
FIGS. 7*a* and 7*b* are an illustration of an exterior ventilation structure is accordance with an exemplary embodiment.
Figure 7B:
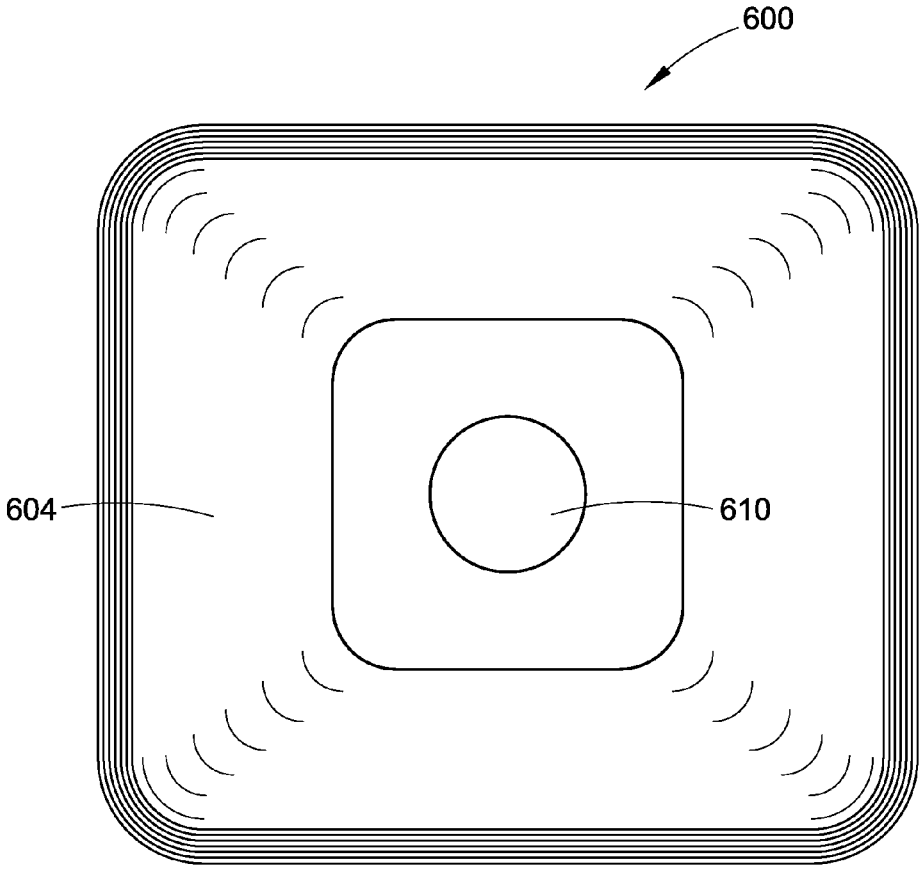

FIGS. 7*a* and 7*b* show a side and a top view of an exterior ventilator structure 600 which can provide light and/or ventilation to a space. The ventilation structure 600 includes a rectangular base 602 that supports an oversized rectangular face plate 604 with rounded corners and a complex curvature of a downwardly convex shape. The base wall 606 is a continuous wall with no vent openings. Several continuous slots 608 are provided in the outer portion of the face plate 604 generally parallel to the outer edge of the face plate 604. The slots 608 are exhaust fan inlets. In one embodiment, the exhaust fan inlets can each have a slot that extends substantially the length of each side of the face plate 604. The slots can be oriented in four directions wherein each direction is parallel to a particular side of the face plate 604.

In one approach, the central portion of the face plate 604 is a circular planar region 610. The circular planar region can be a continuation of the face plate material for an exhaust fan only appliance, accommodate a lens for a light in an exhaust fan light combination and the like. In another approach, the circular planar region 610 is a recess wherein a lens is provided to accommodate an illumination component (not shown) such as a halogen bulb, incandescent bulb, electroluminescent panel, etc. In another embodiment, the central portion of the face plate 604 recedes upwardly behind the illumination component and can be utilized for air flow purposes and/or as a heater vent.

In a disparate embodiment, the circular planar region 610 is recessed wherein a second face plate portion is located below the recessed circular planar region 610. Two light sources are provided. A halogen lamp is provided at the center of the circular planar region 610 and a lamp is provided behind the central face plate to provide indirect lighting on the recessed circular planar region 610 of the primary face plate 604. Utilizing a central recess in combination with the peripheral concealed venting provides novel improvements over conventional exterior ventilation structures. Additional improvement is achieved by combining the central recess/concealed venting with indirect lighting, as disclosed above.

Additionally, a switch 672 can be coupled to the one or more of the ventilation components described above. In one example, the switch 672 is a momentary contact switch. In this approach, the momentary contact switch is coupled to a processing component (e.g., relay, controller, processor, etc.). The switch 672 can be coupled to the processing component utilizing a single connection such as a twisted pair of wires, for example. Thus, this design can allow simple installation of the ventilation component. Rather than multiple wires being run to a multiple switch box to afford the above variances, a momentary contact switch with a processing component is contemplated.

The momentary contact switch can allow power to be delivered to one or more components associated with the ventilation component. Such components include the impeller, one or more low power illumination elements and one or more high power illumination elements. The momentary contact switch can allow a user to provide power to one or more components by depressing the switch one or more times. Depressing the switch can create a pulse which can be sent to the processing component. The one or more pulses received by the processing component can be correlated to a particular output which can allow power to flow to the one or more components. The processing component can be programmed to allow a user to correlate a particular number of pulses with a particular output.

In an alternative embodiment, the switch 672 can be a simple on/off design that allows power to be provided or not provided to the entire ventilation component. In yet another embodiment, a rotary switch can be employed that allows disparate combinations of components (e.g., impeller, high power illumination element, low power illumination element, etc.) to be powered. In one example, the rotary switch can be developed as a continuing on/off breaker thus moving the current operation to the next operation.

It is to be appreciated by one skilled in the art that although various embodiments have been disclosed herein, other embodiments may be contemplated.

The invention claimed is:

1. A ventilation system, comprising:

an impeller;

a unitary molded housing that defines a flow path and one or more mounting structures, wherein the flow path and the mounting structures are integrated into the unitary molded housing, the shape of the flow path surrounds the impeller in a descending spiral, which is defined by:

a first point that is located at a maximum radius from a center point, the first point corresponds to a value of Z=0 a second point that represents a radius located ninety degrees clockwise from the first point, the second point corresponds to a value of Z=1;

a third point that represents a radius located ninety degrees clockwise from the second point, the third point corresponds to a value of Z=2; and wherein the flow path is defined by at least a first radius, a second radius and a third radius, wherein the first radius is orthogonal to the second radius, and the second radius is orthogonal to the third radius, and the value of each radius is a function of $XY^Z$, wherein X is the first radius, Y is a constant that spirally decreases the value of subsequent radii, and Z is a real number from zero to two, wherein zero corresponds to the first radius and two corresponds to the third radius to at least one of minimize noise and/or be matched to the impeller to optimize efficiency;

an exterior structure coupled to the unitary molded housing, the exterior structure includes at least one inlet port, the at least one inlet port being concealed from view; and at least one recess coupled to the exterior structure that accommodates at least one illumination element.

2. The ventilation system of claim 1, further including:

at least one exhaust port that is integral to the unitary molded housing, the at least one exhaust port allows air to be expelled from the flow path into a space; and an impeller that draws air into the at least one inlet port from a first space to the flow path and expels air from the flow path to a second space via the at least one exhaust port.

3. The ventilation system of claim 1, the impeller further including:

a structure that includes one or more vanes to direct the flow of air when rotated; and a motor that rotates the structure.

4. The ventilation system of claim 1, wherein the exterior structure includes:

a downwardly facing face plate with a radius of curvature in one axis only, wherein the face plate sits below a rectangular base; at least two of the walls of the base have open slots to form the inlet port and wherein the sides of the base are recessed with respect to the edges of the face plate.

5. The ventilation system of claim 4, further including:

a central race track portion which is substantially rectangular in shape with two short sides and two long sides, wherein the long sides of the race track portion are parallel to two sides of the face plate, the race track portion is a curved portion of the face plate joining the face plate at its outer periphery and curving upwardly to an edge slightly behind a panel forming an infield portion of the race track to provide an additional concealed air flow path.

6. The ventilation system of claim 5, wherein the infield portion of the race track is one of a transparent and translucent lens behind which resides an illumination element and an opaque panel with two circular apertures wherein each aperture accommodates one or more illumination elements.

7. The ventilation system of claim 1, wherein the illumination element is at least one of an incandescent bulb, a fluorescent bulb, a halogen lamp, a high intensity discharge lamp, a light emitting diode, and an electroluminescent illumination device.

8. The ventilation system of claim 1, wherein the exterior structure includes:

a race track component that is oriented in a corner to corner orientation relative to the exterior structure;

an open slot that surrounds the race track component to provide air inlet means for the exterior structure, wherein the inlet means to the ventilation system is hidden from view to conceal at least one of accumulated dust and dirt; and at least two high power illumination elements that are disposed at two ends of the race track component.

9. The ventilation system of claim 8, further including:

at least one low power illumination element placed on the exterior structure in a location not occupied by the race track component; and a switch that provides power to at least one of the impeller, the high power illumination elements and the low power illumination elements.

10. The ventilation system of claim 9, wherein:

the at least two high power illumination elements are at least one of a halogen lamp, a high intensity discharge lamp, and an incandescent bulb; and the at least one low power illumination element is at least one of an electroluminescent panel, a light emitting diode and a fluorescent lamp.

11. The ventilation system of claim 1, wherein the exterior structure includes:

a base having two parallel vertical side walls, a rear vertical wall having a curve of uniform radius of curvature bulging rearwardly at its center, and a front wall wherein the front wall has a short vertical planar segment adjacent each side wall and a central segment of uniform curvature forming a semicircular segment;

a first face plate that connects the bottom edges of the two side walls and the rear wall, wherein the first face plate has a curvature and is convex when viewed from below, the forward edge of the first face plate surface is concave to create an apparent cavity, the first face plate includes an upwardly sloping segment directly adjacent the semicircular forward edge;

a mushroom shaped component that includes a support and a domed downwardly facing surface coupled thereto to form a second face plate, wherein the mushroom shaped component sits within the apparent cavity created by the concave forward edge of the first face plate, the mushroom shaped component can accommodate one or more illumination elements, and wherein the first face plate includes a surface extending under the domed surface to conceal an air intake area; and a curving recessed base wall that extends upwardly from the dome surface of the mushroom shaped component, wherein half of the curving recessed base wall is at least half contained within the concave edge of the first face plate and the central segment.

12. The ventilation system of claim 11, further including:

a first recess in the base that accommodates a high power illumination element; and a second recess in the base that accommodates a low power illumination element.

13. A ventilation component, comprising:

a unitary molded housing that defines a flow path and one or more mounting structures;

a ventilator structure coupled to the unitary molded housing, the ventilator structure includes at least two end panels and a curved and/or segmented downwardly facing face plate which includes one or more steps configured such that one or more pairs of steps have similar offset distances relative to the ventilator structure;

at least one inlet port that allows air to be drawn into the flow path from a first space;

at least one exhaust port wherein air is expelled from the flow path into a second space;

an impeller that draws air into the at least one inlet port from a first space to the flow path and expels air from the flow path into a second space via the at least one exhaust port the shape of the flow path surrounds the impeller in a descending spiral, which is defined by:

a first point that is located at a maximum radius from a center point, the first point corresponds to a value of Z=0 a second point that represents a radius located ninety degrees clockwise from the first point, the second point corresponds to a value of Z=1;

a third point that represents a radius located ninety degrees clockwise from the second point, the third point corresponds to a value of Z=2; and wherein the flow path is defined by at least a first radius, a second radius and a third radius, wherein the first radius is orthogonal to the second radius, and the second radius is orthogonal to the third radius, and the value of each radius is a function of $XY^Z$, wherein X is the first radius, Y is a constant that spirally decreases the value of subsequent radii, and Z is a real number from zero to two, wherein zero corresponds to the first radius and two corresponds to the third radius; and one or more exhaust fan intake slots that are disposed at either end panel of the ventilator structure.

14. The ventilation component of claim 13, wherein the one or more steps include:

one or more light receptacles that accommodate at least one of a high power illumination element and a low power illumination element.

15. The ventilation component of claim 14, wherein the illumination element is one of an incandescent bulb, a fluorescent bulb, a halogen lamp, a high intensity discharge lamp, a light emitting diode, and an electroluminescent illumination device.

16. The ventilation component of claim 14, further including:

a switch that provides power to at least one of the impeller, the high power illumination elements and the low power illumination elements.

17. A ventilation component, comprising:

a unitary molded housing that defines a flow path and one or more mounting structures;

an exterior ventilator structure coupled to the unitary molded housing that includes:

a rectangular base that supports an oversized rectangular face plate with rounded corners and a curvature of a downwardly convex shape, wherein the exterior ventilation structure includes one or more illumination elements;

at least one inlet port in the exterior ventilator that allows air to be drawn into the flow path from a first space, wherein each inlet port is a slot located in the outer portion of the face plate which is generally parallel to the outer edge of the face plate;

at least one exhaust port that is integrated into the unitary molded housing wherein air is expelled from the flow path into a second space;

an impeller coupled to the unitary molded housing that draws air into the at least one inlet port from a first space to the flow path and expels air from the flow path into a second space via the at least one exhaust port the shape of the flow path surrounds the impeller in a descending spiral, which is defined by:

a first point that is located at a maximum radius from a center point, the first point corresponds to a value of Z=0 a second point that represents a radius located ninety degrees clockwise from the first point, the second point corresponds to a value of Z=1;

a third point that represents a radius located ninety degrees clockwise from the second point, the third point corresponds to a value of Z=2; and wherein the flow path is defined by at least a first radius, a second radius and a third radius, wherein the first radius is orthogonal to the second radius, and the second radius is orthogonal to the third radius, and the value of each radius is a function of $XY^Z$, wherein X is the first radius, Y is a constant that spirally decreases the value of subsequent radii, and Z is a real number from zero to two, wherein zero corresponds to the first radius and two corresponds to the third radius; and a switch that employs a momentary action that is coupled to the ventilation component to provide power to at least one of the one or more illumination elements and the impeller.

18. The ventilation component of claim 17, wherein the exhaust fan inlets each have a slot that extends substantially the length of each side of the face plate, the slots are oriented in four directions wherein each direction is parallel to a particular side of the face plate.

* * * * *